United States Patent [19]

Stein

[11] 3,995,927

[45] Dec. 7, 1976

[54] FRONT RELEASE DRAWER SLIDE

[75] Inventor: Robert R. Stein, Mt. Kisco, N.Y.

[73] Assignee: Hardware Designers, Inc., Mt. Kisco, N.Y.

[22] Filed: Feb. 2, 1976

[21] Appl. No.: 654,238

[52] U.S. Cl. ..... 312/333; 312/341 R; 308/3.8

[51] Int. Cl.[2] ..... A47B 88/16; F16C 21/00

[58] Field of Search ..... 312/333, 341, 346–350; 308/3.6, 3.8

[56] References Cited

UNITED STATES PATENTS

| | | | |
|---|---|---|---|
| 3,123,419 | 3/1964 | Maxwell | 312/333 |
| 3,142,517 | 7/1964 | Ward | 312/341 R |
| 3,243,247 | 3/1966 | Knappe | 312/333 |
| 3,328,106 | 6/1967 | Mullin | 312/341 R |
| 3,701,577 | 10/1972 | Fischer | 312/348 |

*Primary Examiner*—Casmir A. Nunberg
*Attorney, Agent, or Firm*—Mark T. Basseches; Paula T. Basseches

[57] ABSTRACT

The present invention is directed to improvements in the art of drawer suspensions, and particularly to an improved front release drawer suspension of the type used for supporting a drawer within a cabinet and providing an initial stop limiting outward movement of the drawer, yet permitting the drawer to be removed from the cabinet in a forward direction by decoupling the drawer mounted and cabinet mounted suspension components. More particularly, the invention relates to a drawer slide of the type described, characterized by the inclusion of release pawls extending forwardly of the front face of the cabinet in the fully extended position of the drawer, permitting facile visual and manual access thereto, the slide mechanism being further characterized by a shallow vertical profile, permitting the use thereof on relatively shallow drawers.

3 Claims, 6 Drawing Figures

FRONT RELEASE DRAWER SLIDE

BACKGROUND OF THE INVENTION

1. Field of the Invention

The present invention is in the field of drawer hardware and particularly relates a drawer suspension, certain elements of which are secured to a cabinet adjacent an opening, other elements of which are secured to the drawer.

2. The Prior Art

It is known to provide a two part drawer hanger apparatus including anti-friction roller means or the like adapted to be secured to a drawer and to adjacent portions of the cabinet surrounding the drawer, whereby the retraction and return movement of the drawer may be smoothly effected and with a minimum of friction.

It is likewise known to provide means for limiting the distance which the drawer may be withdrawn so that the latter may not be inadvertently pulled clear of the cabinet.

Certain drawer slides of the type described employ gravity pawl mechanisms which function initially to stop the drawer, the pawls being thereafter actuable for removal of the drawer. Such devices as were heretofore known are disadvantageous in that it is necessary, to effect removal of the drawer, for the operator to reach into the cabinet, e.g., rearwardly of the forward line of the cabinet, to trip the pawls. Unless the user is familiar with the location of the pawls, removal is accomplished only with difficulty. Examples of prior art drawer slides having pawl structures of the type described may be found in U.S. Pat. Nos. 3,243,247 and 3,328,106.

Such structures, in addition, are disadvantageous in that they increase the overall profile of the slide construction in the heightwise direction, precluding their use in situations where it is desired to assemble a multiplicity of stacked shallow drawers.

Certain other slide constructions, e.g. a construction identified as Model 178, appearing in Catalogue No. 26 of Capital Hardware Mfg. Co. Inc., overcome certain of the disadvantages hereinabove set forth, increasing the accessibility of the pawl at the front of the cabinet. Such devices, however, do not provide the desired low profile effect and mandate, in accordance with their intended operation, the provision of additional vertical space. Also, the latching portion of the pawl of such device extends beyond the confines of the slide channels, raising the possibility that the latch may be tripped by material extending from a lower drawer, etc.

SUMMARY

The present invention may be summarized as directed to an improved drawer slide or suspension of the type in which a pair of elongate U-shaped metallic members span the distance between each side of the drawer and adjacent interior portions of a cabinet.

The slides include the usual anti-friction means, such as rollers, permitting the weight of the drawer to be borne by the rollers, facilitating the extending and return movements of the drawer. The device is characterized by the provision of a gravity pawl release mechanism which functions to prevent the drawer from inadvertently being removed by providing a positive stop to such removal.

The pawls are freely accessible, being disposed outwardly of the cabinet in the withdrawn limiting position of the drawer, and are further characterized in that all portions of the pawl are contained within the heightwise dimensions of the channels, whereby it is feasible to make a low profile suspension without any additional clearance allowances for the accommodation of the latching and latch receiving components of the pawl.

Accordingly, it is an object of the invention to provide an improved drawer suspension.

A still further object of the invention is the provision in a drawer suspension of an improved latching pawl construction, the pawl providing a stop against inadvertent removal of the drawer and being visually and manually accessible forwardly of the cabinet when the drawer reaches the stop position.

Still a further object of the invention is the provision of a suspension of the type described wherein the pawl is contained entirely within the dimensions of the suspension and does not project therefrom in an upward or downward direction, minimizing clearance requirements.

Still a further object of the invention is the provision of a drawer suspension of the type described which may be inexpensively constructed, and is durable and efficient in its operation.

To attain these objects and such further objects as may appear herein or be hereinafter pointed out, reference is made to the accompanying drawings, forming a part hereof, in which.

Figure 1:
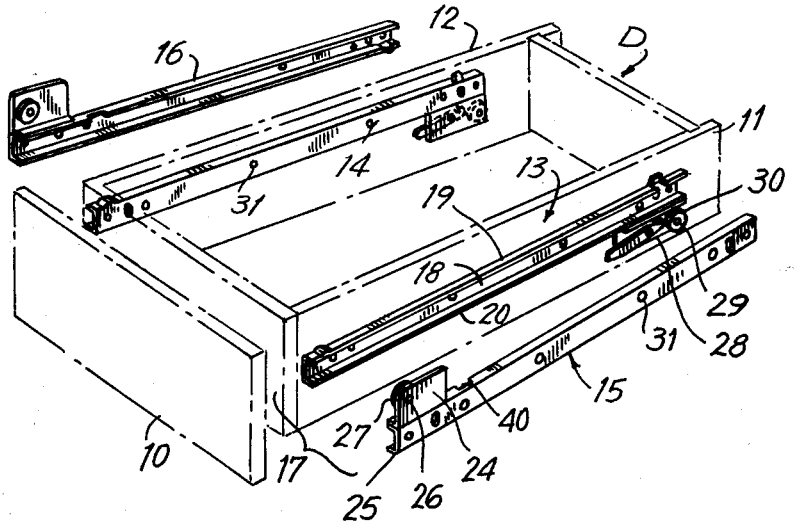
FIG. 1 is a perspective view of a drawer and slide assembly in accordance with the invention, the cabinet mounted components of the suspension being spaced from the drawer mounted components for clarity of illustration.

Turning now to the drawings, there is shown in FIG. 1 a drawer D having a front face 10. Each of the side walls 11, 12 of the drawer D carries a component 13, 14 of a two part suspension assembly, the other components 15, 16 of which are mounted to the cabinet wall W paralleling and adjacent the drawer. Since the slide suspension formed by the elements 13, 15 and 14, 16 are identical except for "handing", i.e., they are allochiral and form mirror images of each other, the device will be described in connection with a single suspension 17 which is comprised of the elements 13, 15.

In accordance with the invention, the drawer mounted component 13 of the suspension 17 constitutes an elongate metal member which is generally U-shaped in transverse section, including a central branch or web 18, and upper and lower legs 19, 20, respectively. In similar fashion, the cabinet mounted element 15 includes a web or branch 21 and upper and lower legs 22, 23, respectively. A bracket 24 is fixed to the forward end 25 of the cabinet mounted element 15 as by welding, riveting, etc.

The bracket 24 supports a horizontal stub shaft 26, on which is rotatably mounted an anti-friction roller 27. Similarly, a bracket 28 depends from the drawer mounted section 13 and carries on shaft 29 a roller 30.

As will be appreciated from an inspection of the drawings, in the assembled position of the sections 13 and 15 the roller 27 of the cabinet mounted section 15 underlies and supports the upper leg 19 of the drawer mounted component 13 and the roller 30 of the drawer mounted section underlies and supports the upper leg 22 of the cabinet mounted section 15.

The branches or webs 18 and 21 of the components 13 and 15, respectively, are provided with throughgoing apertures 31, through which screws or like mounting means may be passed, to permit attachment of the channel sections to the drawer and cabinet, respectively.

The suspension as thus far described is conventional and provides a means to permit smooth travel of the drawer out of and into the cabinet.

The principal innovation hereof lies in the latching mechanism next to be described, which functions to prevent the drawer from being bodily withdrawn from the cabinet without manual activation of components of the latching mechanism.

The latch mechanism includes a latching pawl 33 mounted on a horizontal pivot pin 34 secured to the bracket 28. The pawl 33 includes an aperture 35 which loosely surrounds the pin 34, the pin being headed so as to maintain the pawl in captive but pivotal position on the bracket.

The pawl includes adjacent its rearward end 36 (the end furthest from the front of the drawer) a latching portion 37 in the form of an essentially vertically directed shoulder. It will be noted that the forward end 38 of the pawl is spaced further from the pivot pin 34 than the rear portion 36, whereby under gravitational influences the forward portion, being heavier than the rearward portion, causes the pawl to be rotated to a normal anti-clockwise orientation.

Figure 2:
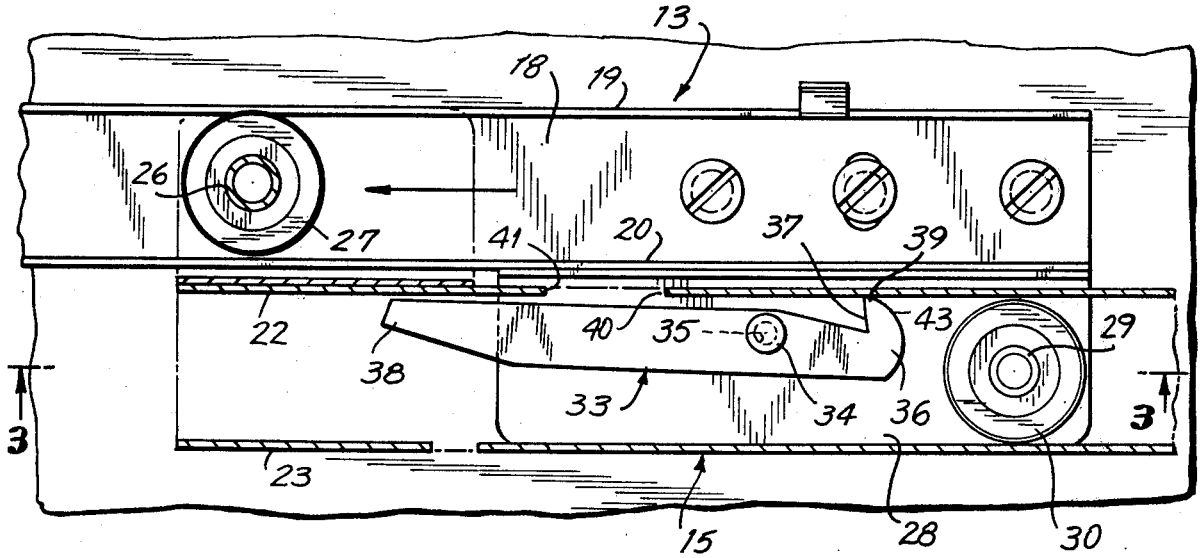
FIG. 2 is a magnified sectional view of the latching components of the assembly as the same approach the latching or fully retracted position thereof.
Figure 3:
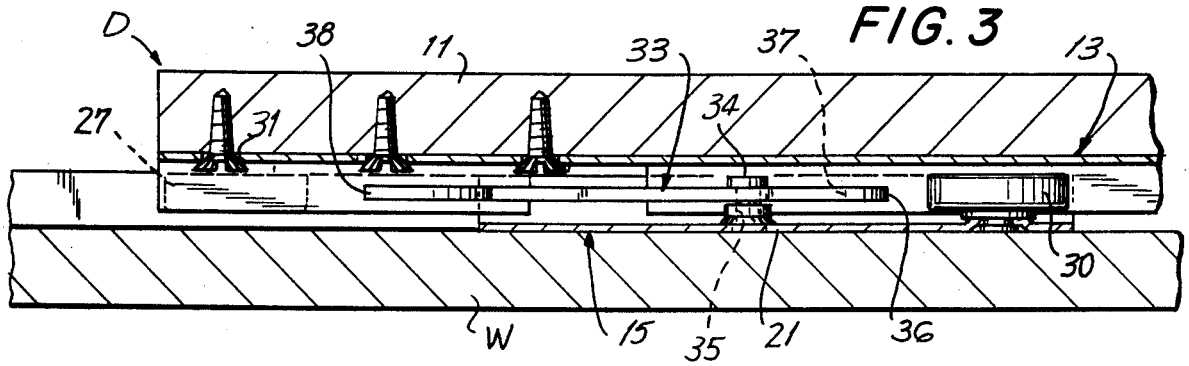
FIG. 3 is a horizontal section taken on the line 3—3 of FIG. 2.
Figure 5:
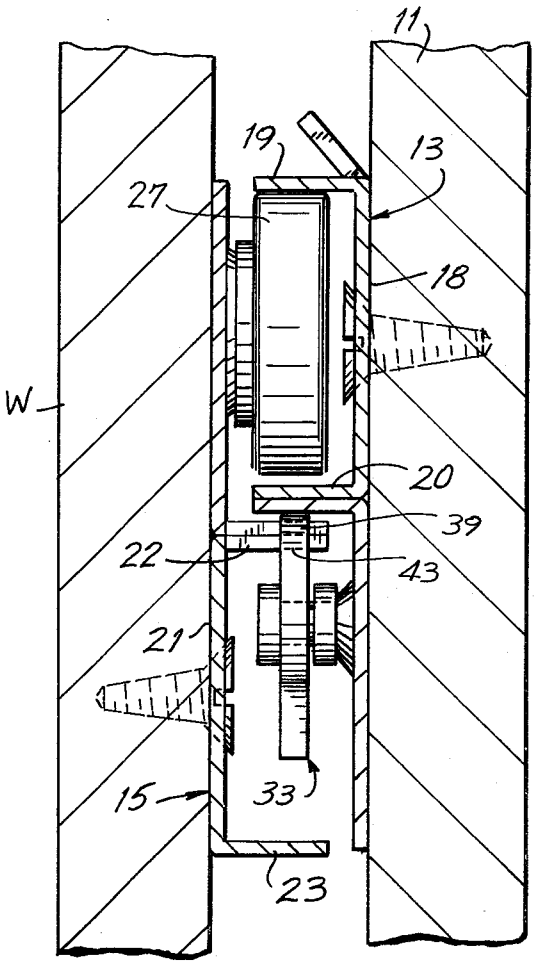
FIG. 5 is a section taken on the line 5—5 of FIG. 4.

In normal operation, i.e., when the drawer is moved from its fully seated to its withdrawn position, the uppermost end or head 39 of the pawl adjacent the latching shoulder 37 will be urged lightly against and ride on the undersurface of the upper leg 22 of the channel 15 — see FIG. 2.

The leg 22 of the channel 15 includes a latching slot 40 adjacent its forward end. As will be seen from FIG. 4, when the drawer is withdrawn sufficiently far that the head 39 of the pawl is in registry with the slot 40, the pawl will tilt in an anti-clockwise direction under gravitational influences until the latching shoulder 37 is extended upwardly through the slot. It will be observed from an inspection of FIG. 4 that attempts to remove the drawer in an outward direction will be blocked by the interengagement of the shoulder 37 and the ledge portion 41 defined by the outermost end of the slot 40.

Figure 4:
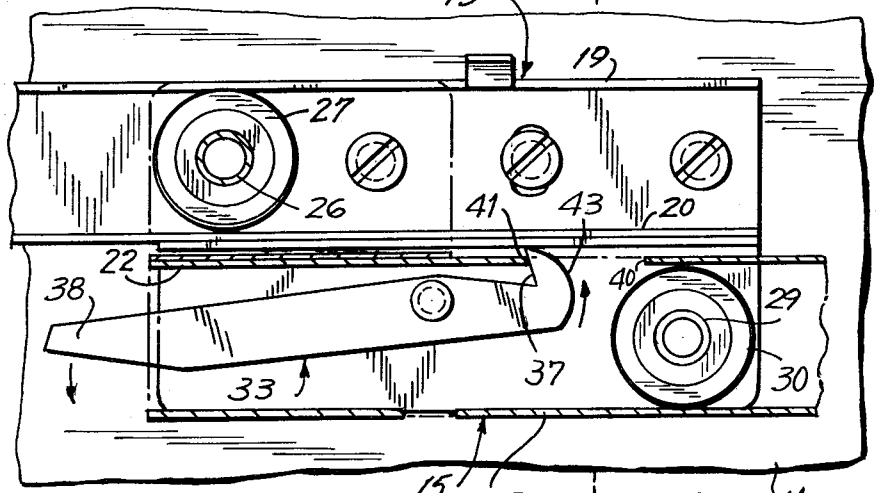
FIG. 4 is a view similar to FIG. 2 showing the position of the parts in the latched or fully withdrawn condition.
Figure 6:
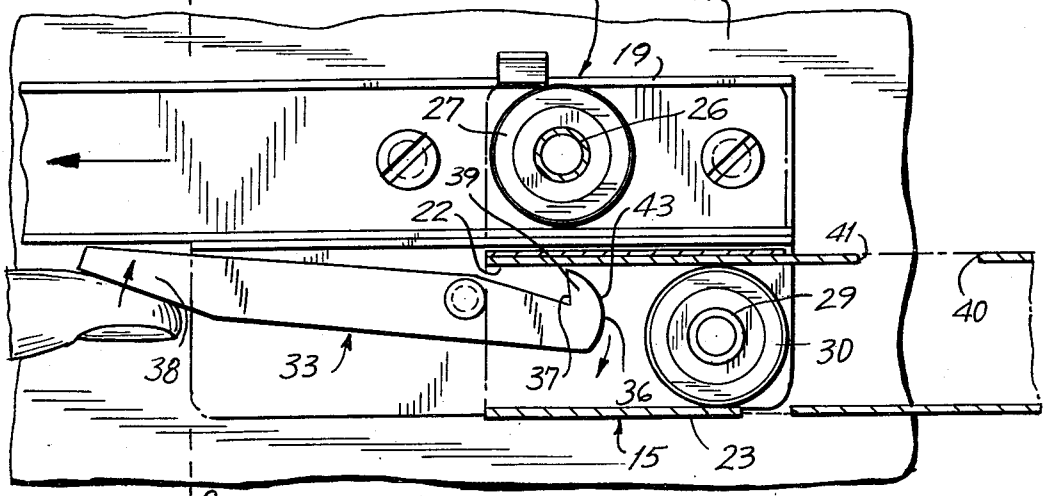
FIG. 6 is a view similar to FIG. 5 showing the position of the parts after the pawl has been depressed for removal of the drawer.

It should be further understood from an inspection of FIGS. 4 and 6 that in the noted outer limiting position of the drawer, the forward portion 38 of the pawl extends forwardly of the cabinet line C—C, FIG. 6, whereby the same is visually and manually accessible to anyone desirous of removing the drawer. Such removal is effected by upwardly pressing the end 38, whereby the pawl is tilted in a clockwise direction against the influence of gravity and the latching shoulder 37 is removed from the latching slot 40. It will be understood that the pawls of the suspensions at both sides of the drawer must be depressed simultaneously in order to effect removal of the drawer.

It will be further understood that in order to effect removal, the forward portions 38 of the pawls are raised or lifted in an upward direction. Such raising or lifting movement is a far more natural and facile manoeuver than that required in other slide suspensions wherein the accessible or marginally accessible portion of the pawls must be simultaneously depressed as the drawer is lifted. In contrast, in the instant device, the drawer may be removed by a simple lifting movement effected by grasping the forward ends 38 of the pawls.

Preferably, the rearmost upper surface 43 of the pawl 33 is curved or inclined in a downward and rearward direction. Such inclination facilitates reassembly of the drawer within the cabinet since the inward movement of the properly positioned drawer will cause the surface 43 to engage against the forward or outermost end of the branch 22, automatically deflecting the pawl in a clockwise direction to the position shown in FIG. 2, and permitting reassembly of the drawer and cabinet by a simple inward movement of the drawer.

From the foregoing it will be seen that an essentially conventional suspension slide assembly has been provided with an improved latch release means, the release means incorporating portions lying forwardly of, or at the front face of, the cabinet whereby they are readily accessible both visually and manually to an individual seeking to remove a drawer.

The pawl assembly is further advantageous in that the pawls are tripped by a lifting movement, which is a natural movement by which a drawer would be expected to be removed.

Additionally and importantly, all components of the locking mechanism are disposed entirely within the upper and lower limits defined by the profile of the channels. In this way, and in contra-distinction to pawl assemblies heretofore known, the height of the suspension is dictated solely by the channel height and additional clearances between adjacent stacked drawers need not be allowed. The assembly may accordingly be used for supporting drawers in dentists' cabinets, for instance, or in like applications where shallow drawers are typically employed.

The assembly, although providing the advantages hereinabove set forth, involves no increase in cost.

Having thus described the invention and illustrated its use, what is claimed as new and is desired to be secured by Letters Patent is:

1. A front removable drawer slide assembly comprising, in combination, first and second elongate channels generally U-shaped in transverse section, said channels each including a central web defining the branch of said U and a pair of spaced parallel track portions extending from the extremities of said branch and defining the legs of said U, said channels being disposed in stacked parallel relation, with said webs being in laterally offset vertical planes and said branches extending in opposite directions, with the lower branch of said upper channel being in proximate spaced relation to the upper branch of said lower channel, anti-friction means mounted on each said channel and extending into the other said channel for slidably supporting said channels for relative longitudinal movement, and a gravity actuated front release latch assembly releasibly limiting longitudinal movement of said channels, said assembly including a pawl member mounted on said upper channel adjacent a rear end thereof for pivotal movement in a vertical plane about a horizontal pivot member fixed to said upper channel, said pawl being normally disposed entirely within said lower channel and including at the rear end thereof a vertically directed latch portion, and at the outer end thereof a forwardly extending trip portion, said pawl being unbalanced about said pivot member whereby said latch portion is urged under gravitational influences toward a normally elevated position, said latch portion of said pawl member underlying and slidably engaging the undersurface of said upper branch of said lower channel, and a latching slot formed in said upper branch of said lower channel adjacent the forward end thereof, said slot being located to register with said latch portion at a position corresponding to the fully extended condition of said channels, said latch portion being gravitationally projected upwardly into said slot in said registering position, whereby said channels are locked against further outward sliding movement.

2. Apparatus in accordance with claim 1 wherein said trip portion of said pawl extends forwardly beyond the forwardmost portion of said lower channel in said fully extended condition of said channels.

3. Apparatus in accordance with claim 2 wherein said latch portion is released from said latching slot responsive to a lifting force on said tripping portion.

* * * * *